United States Patent [19]

Yamada

[11] 4,409,810

[45] Oct. 18, 1983

[54] PROCESS FOR MANUFACTURING SEAMLESS METAL TUBES

[75] Inventor: Tateo Yamada, Amagasaki, Japan

[73] Assignee: Sumitomo Kinzoku Kogyo Kabushiki Kaisha, Osaka, Japan

[21] Appl. No.: 281,902

[22] Filed: Jul. 9, 1981

[30] Foreign Application Priority Data

Jul. 18, 1980 [JP] Japan ..... 55-98949

[51] Int. Cl.[3] ..... B21B 19/06

[52] U.S. Cl. ..... 72/68; 72/97; 72/368

[58] Field of Search ..... 72/68, 95, 97, 100, 72/368; 29/527.7

[56] References Cited

U.S. PATENT DOCUMENTS 3,495,429 2/1970 Muller ..... 72/100

*Primary Examiner*—Lowell A. Larson

*Attorney, Agent, or Firm*—Burns, Doane, Swecker & Mathis

[57] ABSTRACT

The present invention relates to manufacturing process of seamless metal tubes by elongating mill such as Mannesmann mandrel mill. Shells are subjected to rolling operation with main object of wall thickness equalization by means of a rotary mill having 3 rolls without any internal tools such as mandrel bar or plug. This process improves wall eccentricity and enables to decrease the number of billets as materials for tube making.

5 Claims, 12 Drawing Figures

FIG.6
PRIOR ART
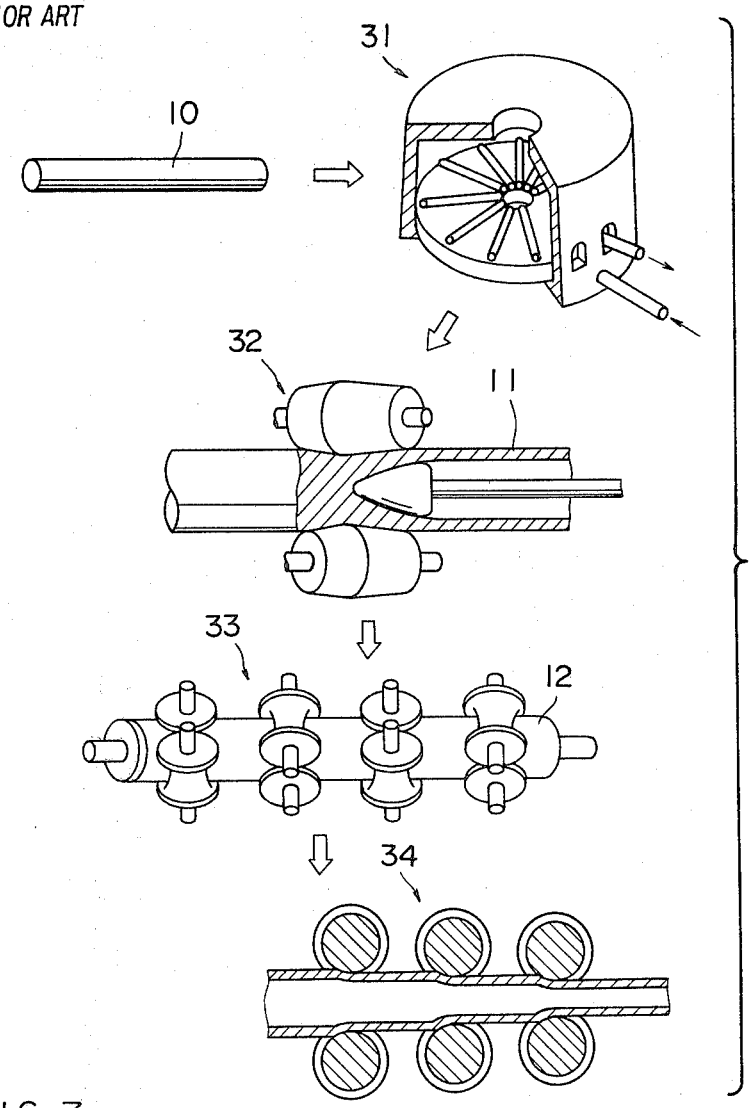
FIG.7
PRIOR ART
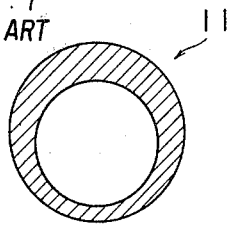
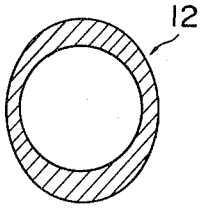
FIG.8
PRIOR ART

PROCESS FOR MANUFACTURING SEAMLESS METAL TUBES

BACKGROUND OF THE INVENTION (1) Fields of the Invention

The present invention relates to a process for manufacturing seamless metal tubes wherein hollow shells produced by piercing billets are subjected to wall thickness equalization, and subsequently are processed by elongating mill, such as Mannesmann mandrel mill line, Mannesmann plug mill line, Mannesmann multi-stand pipe mill line and Mannesmann assel mill line.

(2) Description of the Prior Art

Seamless metal tubes, and more particularly small-diameter tubes, e.g., tubes 1 to 6 in. in diameter, often involve the problem of wall eccentricity. Concretely, the problem is explained as follows:

The manufacture of small diameter tubes, 1–6 in. in diameter, is conventionally carried out in manner as illustrated in FIG. 6. That is, round bar stock or round billet 10 is heated to 1200°–1250° C. in a rotary hearth furnace 31, pierced by means of a piercing mill 32 (e.g. Mannesmann piercer), and the resulting hollow shell 11 is processed by continuous elongating mill 33 (e.g. a mandrel mill) into a semi-finished pipe 12 having a wall thickness substantially comparable to that of a finished tube. The semi-finished tube 12 is then heated in a reheating furnace (not shown) and sized by means of a stretch reducer 34 to the specified outside diameter. In conjunction with outside diameter sizing, some wall-thickness adjustment is made to obtain the thickness of finished tube. Described above is a typical process for manufacture of small-diameter tubes on a mass-production line known as Mannesmann mandrel mill line. A study of wall eccentricity occurrences under this process revealed that eccectric wall eccentricity in which, as FIG. 7 illustrates, the inside and outside diametral centers do not agree with each other was found with hollow shells 11 from the piercer 32, the wall eccentricity ratio ranging from 5% to 15%. With semi-finished tubes 12 from the elongating mill 33, symmetrical wall eccentricity in which, as FIG. 8 illustrates, the inside and outside diametral centers are identical was found to have occurred in the range of 3 to 5% in terms of wall eccentricity ratio, this eccentricity being added to the above said eccentric wall eccentricity. The term "wall eccentricity ratio" referred to herein is defined as $[(T_{max}-T_{min})/T_{mean}]\times 100\%$, wherein Tmax is maximum wall thickness of tube section, Tmin is minimum wall thickness thereof, and Tmean is mean wall thickness thereof.

No appreciable change was caused at the stretch reducer 34. In effect, the wall eccentricity caused at the piercer 32 was introduced into the finished product substantially as it was. It was also discovered that the continuous elongating mill was ineffective for the purpose of wall thickness equalization and that especially where rolling reduction was not uniform in successive passes, some symmetrcal wall eccentricity was added to the initially caused eccentricity.

In such Mannesmann mandrel mill process there is sometimes provided a shell sizer between the piercer 32 and the continuous elongating mill 33. A shell sizer comprises 5 to 7 stands of 2-roll or 3-roll type, each having grooved rolls, arranged in tandem. Each hollow shell 11 is passed through the shell sizer in the axial direction without rotation, so that its outside diameter is reduced to the required outside diameter. It was primarily for the purpose of decreasing the number of sizes of billets to be provided to meet the specifications of various different finished products that the shell sizer was introduced into the Mannesmann mandrel mill process. Granting that only one size of hollow shell is obtainable from one particular size of billet at the piercer 32, the provision of a shell sizer makes it possible to obtain a plurality of shell sizes. It follows that the shell sizer permits simplification of billet sizes and furthers continuous casting of billets. Even if such sizer is applied, however, the wall eccentricity caused in the earlier stage can hardly be corrected: only slight thickness change takes place adjacent the roll flanges, and there is little metal flow in the peripheral direction of the shell.

In the manufacture of medium-diameter tubes, 6 to 16 inches in diameter, a process known as Mannesmann plug mill process is often used which, as FIG. 9 illustrates, comprises a billet 10 heated in a heating furnace 61 being pierced by a piercer 62 into a hollow shell 11, the shell being passed through a rotary elongator 63 for inside diameter expansion or wall thickness reduction, the resulting product being delivered as such to a plug mill 64, then passed through a reeler 65 and a sizer 66 into a finished product. Said rotary elongator 63 is such that a plug is inserted into the hollow shell 11 to perform wall thickness reduction in cooperation with opposed rolls arranged in oblique relation to the shell, so that wall thickness reduction of hollow shell is performed with outer and inner tools under controlled conditions to permit positive metal flow in the peripheral direction for the correction of any wall eccentricity caused at the earlier stage. Insofar as the plug mill process is concerned, there is not much problem of wall eccentricity with medium diameter tubes as is the case with Mannesmann mandrel process in the manufacture of small diameter tubes. Recently, however, there is a growing tendency that a continuous type elongator called "Multi-stand pipe mill," featuring high reduction capacity and high efficiency, is used in the manufacture of medium diameter tubes. Where such mill is combined with above said piercer, the manufacturing line consists of a heating furnace 71, a piercer 72, a multi-stand pipe mill 73 and a sizer 74, as illustrated in FIG. 10. With such simplified arrangement, one similar to that for small-diameter tube manufacturing, there is involved a problem similar to the one noted with small diameter tubes: that any wall eccentricity as caused at the piercer 72 is carried into the finished product. This difficulty may be overcome by providing a rotary elongator between the piercer and the multi-stand pipe mill 73. Indeed, such arrangement is adopted in a known process wherein square bloom is used as stock and wherein a press piercing mill is used in place of an ordinary-type piercer. This arrangement, however, has an economical disadvantage that there are present two different elongators, that is, rotary elongator and multi-stand pipe mill, which fact is unfavorable from the standpoint of equipment investment efficiency.

OBJECTS AND BRIEF SUMMARY OF THE INVENTION

The above is the technical background in which the present invention has been made.

It is therefore an object of the invention to provide a process for manufacturing seamless metal tubes by using a continuous elongating mill such as mandrel mill or multi-stand pipe mill, or a single-stand type elongator such as plug mill or assel mill, wherein a significant decrease in wall eccentricity ratio can be achieved.

It is another object of the invention to provide a process for manufacturing seamless metal pipes which permits decreasing the number of sizes of billets to be prepared as stock for tube manufacturing and which can be developed into an integrated tube manufacturing line so that continuous cast billets are directly put in process for tube making.

The process for manufacturing seamless metal tubes of the present invention comprises a step of subjecting shell being worked to rolling operation with main object of wall thickness equalization by means of a rotary mill having 3 rolls without any internal tools, said step preceding the wall thickness reduction by elongating mill.

Other objects and novel features of the invention will be apparent from the following description taken in connection with the accompanying drawings.

BRIEF DESCRIPTION OF THE DRAWINGS

FIG. 6 is an ilustration showing the sequence of manufacturing stages in conventional Mannesmann mandrel mill process.

FIG. 7 is an explanatory view showing an eccentric wall eccentricity;

FIG. 8 is an explanatory view showing a symmetrical wall eccentricity;

DETAILED DESCRIPTION OF THE INVENTION

As described before, the process of this invention conprises a step of wall thickness equalization or wall eccentricity correction by means of 3 roll type rotary mill without any internal tools.

The process of wall eccentricity correcting by the rotary mill is such that shells are rolled as they are fed while being rotated, whereby positive metal flow in the peripheral direction takes place despite of the absence of internal sizing tools.

Figure 1:
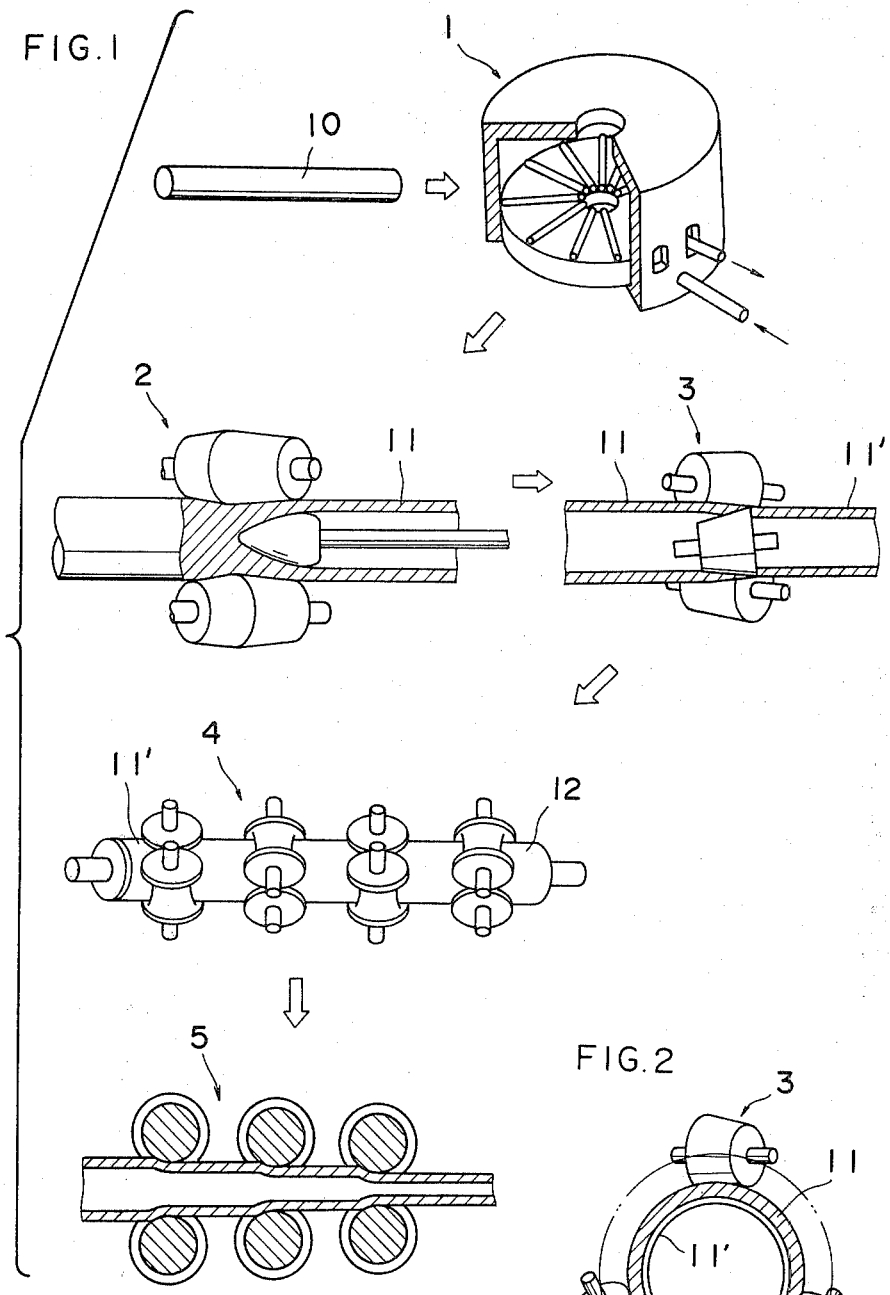
FIG. 1 is an illustration showing the sequence of stages in the process according to the invention.

FIG. 1 shows the sequence of stages in the process of the present invention, as used in the manufacture of small diameter tubes. A round billet 10 is heated to 1200°–1250° C. in a rotary hearth type heating furnace 1, then pierced by a piercer 2 into a hollow shell 11. The hollow shell is then passed through a 3-roll type rotary mill 3 (hereinafter referred to as "wall-thickness equalizer") which has no such internal sizing tool as plug, mandrel bar or the like. The wall-thickness equalizer 3, as stated above, has no internal sizing tool; its primary object is to reduce the outside diameter of the hollow shell 11 so as to correct wall eccentricity. Essentially it is a rolling mill having 3 rolls of truncated cone or barrel shape arranged in oblique relation to the axis of the hollow shell. In configuration, it is similar to a 3-roll type piercer or assel mill from which the plug or mandrel bar, as the case may be, has been removed.

Figure 2:
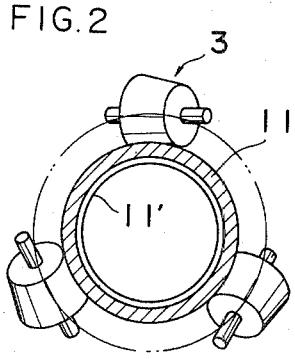
FIG. 2 is an explanatory view showing the inclined disposition of rolls.

The expression "arranged in oblique relation" used herein means that the rolls are arranged in such a way that their respective axes are inclined at an equal angle relative to the condition of their being parallel to the axis of the hollow shell and in the tangential direction of a virtual circle (shown by an alternate long and two-short-dashes line in FIG. 2) centered at the axis of the shell, all the roll axes in the same direction. The inclined roll arrangement is shown in a direction perpendicular to the direction of shell feed in FIG. 1, and in the direction of shell feed in FIG. 2. The angle at which each roll is inclined is referred to as "feed angle" hereinafter.

The wall thickness equalizer 3 performs 5–50% diameter reduction. Correction of the wall eccentricity takes place in the course of the diameter reduction operation. The shell 11' from the equalizer 3 is then fed to the mandrel mill 4 where it is subjected to wall thickness reduction to be made into a semi-finished tube 12 having a wall thickness almost comparable to that of a finished tube. After heated in a reheating furnace (not shown), the semi-finished tube 12 is passed through a reducing mill 5 for sizing into a finished size.

Figure 3:
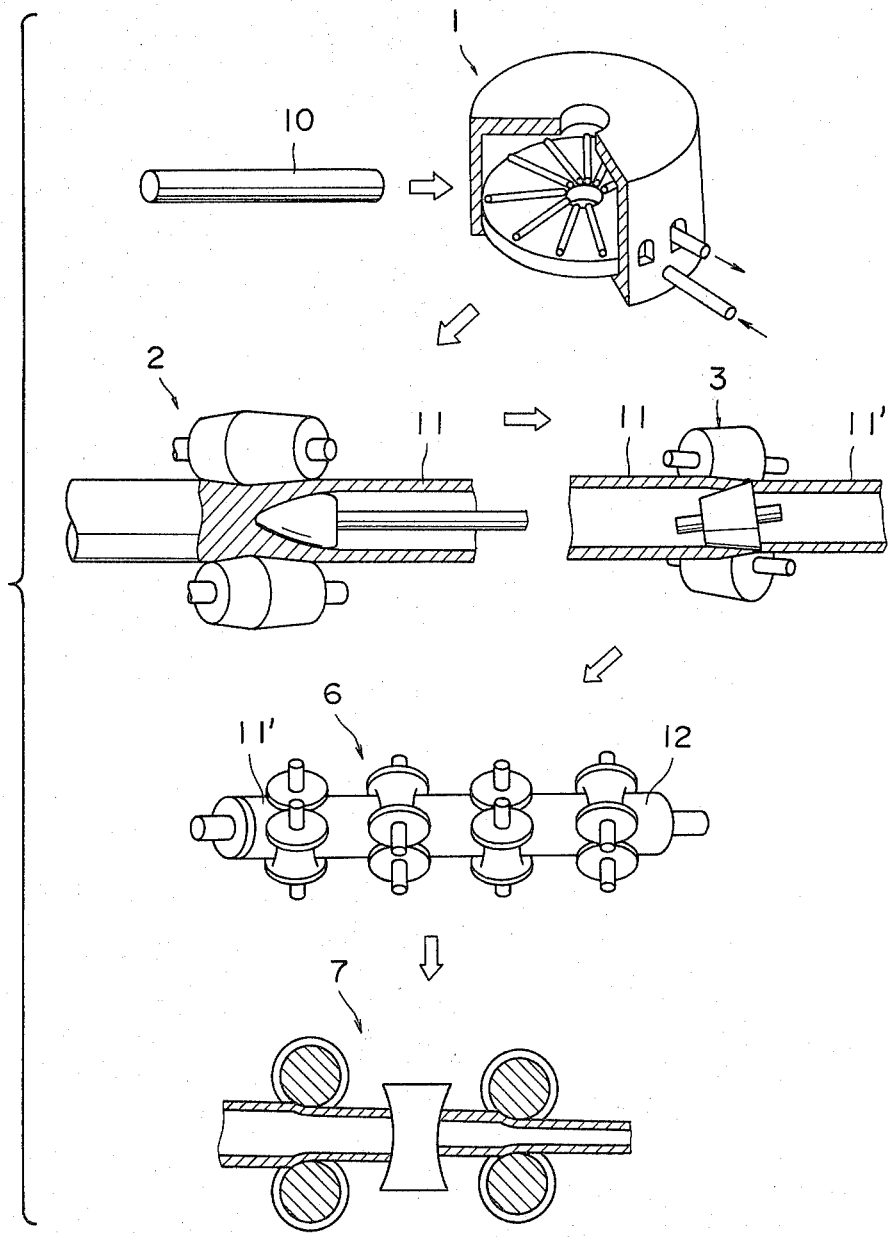
FIG. 3 is an illustrative representation showing the sequence of stages embodying another aspect of the process of the invention.

FIG. 3 illustrates the sequence of stages in the process of the invention, as used in the manufacture of medium diameter tubes. The stages of up to wall eccentricity correcting, namely, heating furnace 1, piercing mill 2 and wall-thickness equalizer 3, are same as those in the case of small-diameter tube making. A hollow shell 11' from the equalizer 3 is fed to a multi-stand pipe mill 6 for working into a semi-finished tube 12 having a wall thickness almost equal to that of a finished tube. After heated in a reheating furnace (not shown), the semi-finished tube 12 is passed through a sizer 7 in which it is worked to the specified size. The two embodiments describer above, both employ a continuous type elongator such as mandrel mill or multi-stand pipe mill, as the case may be. This invention, however, may be equally applied to a tube making line employing a single-stand elongator such as plug mill or the like. For this purpose, the line may comprise a rotary piercer, a wall-thickness equalizer, a rotary elongator, a plug mill, a reeler, and a sizer; or a press piercing mill, a wall-thickness equalizer, a rotary elongator, a plug mill, a reeler, and a sizer.

Figure 4A:
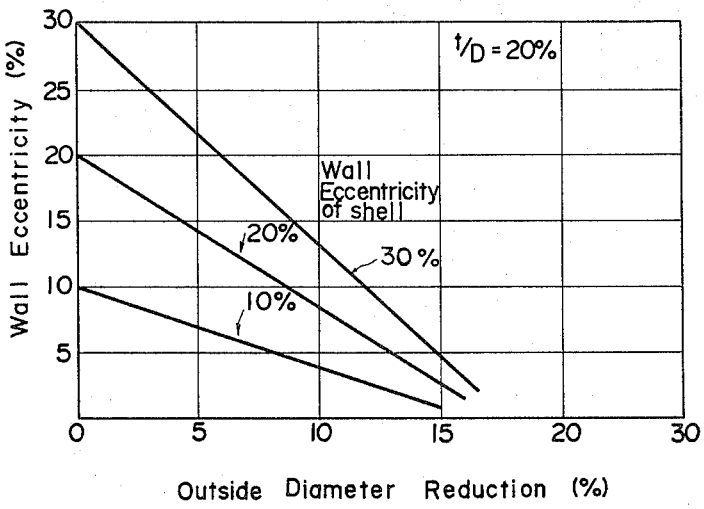
FIGS. 4(*a*) and 4(*b*) are graphs showing the effect of the invention.
Figure 4B:
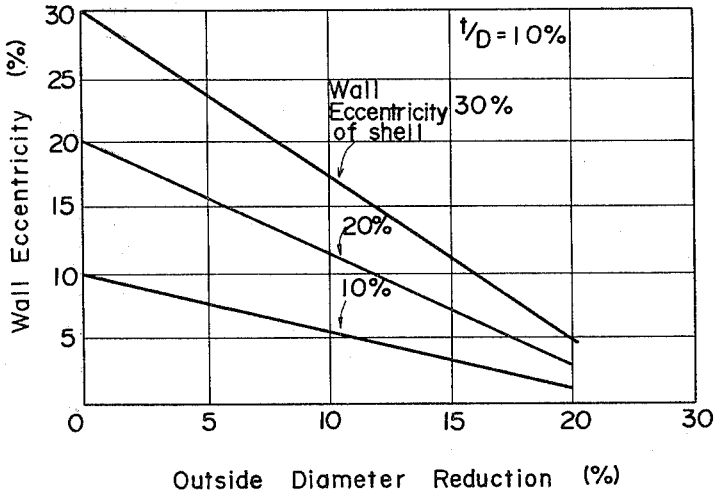
Figure 5A:
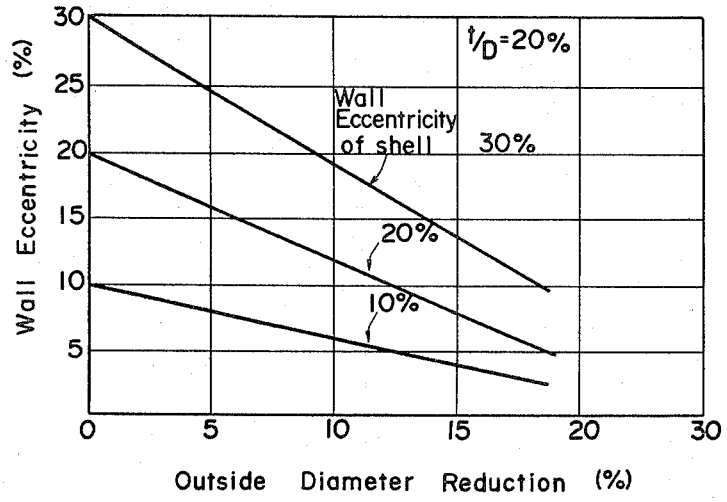
FIGS. 5(*a*) and 5(*b*) are graphical representations showing the effect of the invention where a 2-roll type rotary mill is used.
Figure 5B:
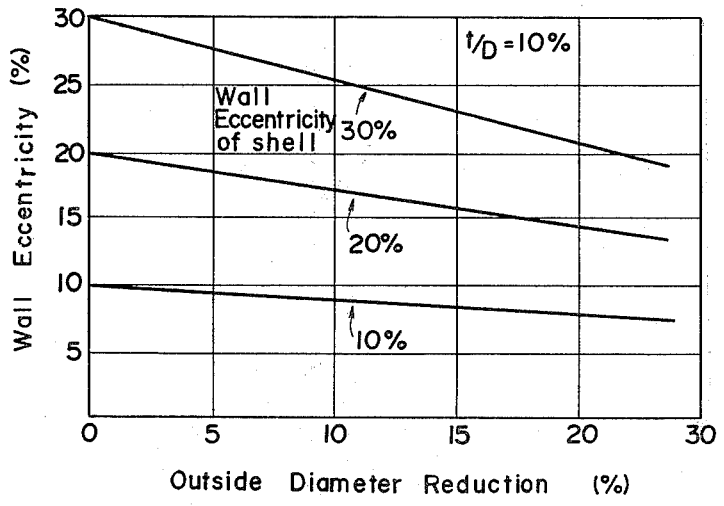
Figure 9:
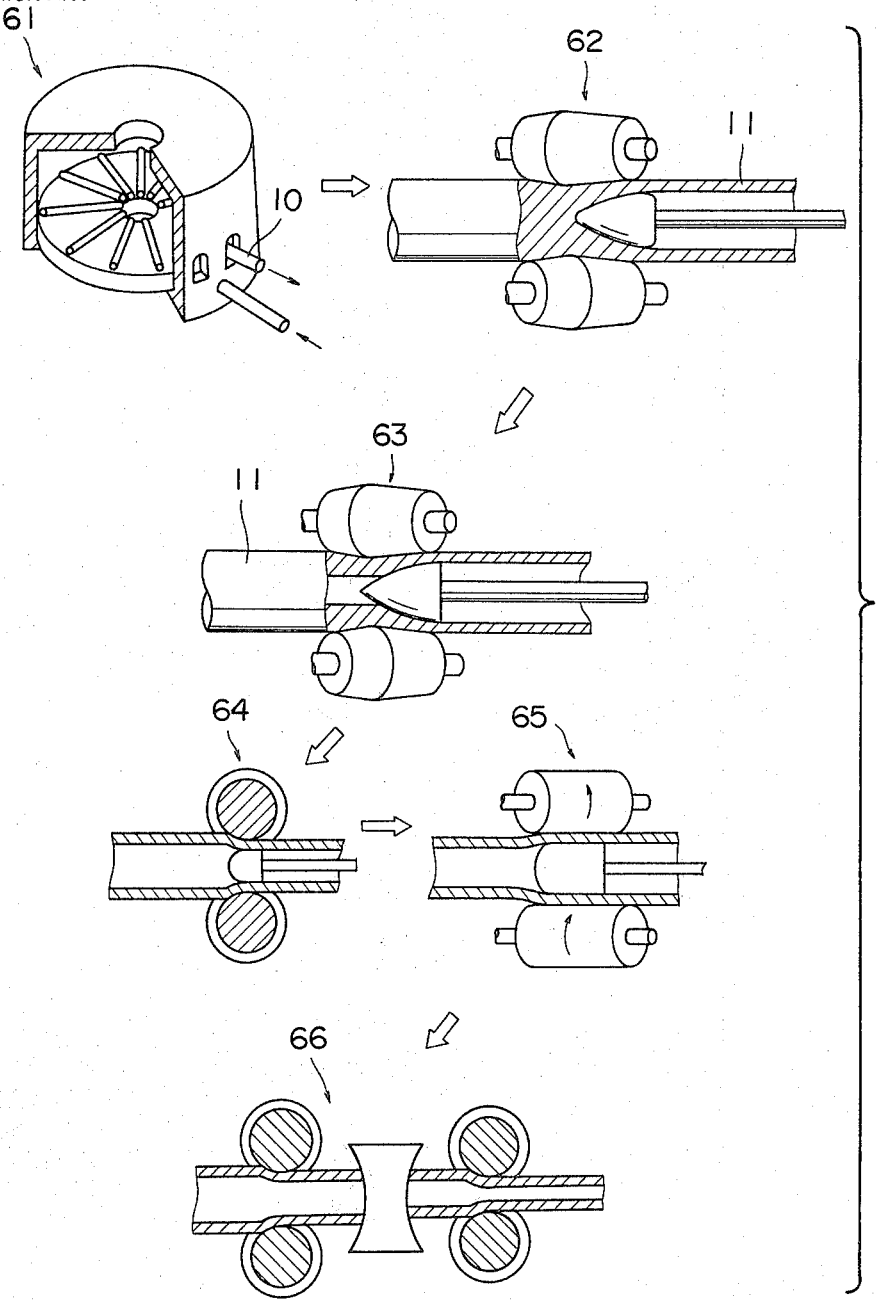
FIG. 9 PRIOR ART
FIG. 9 is an illustration showing the sequence of manufacturing stages in conventional Mannesmann plug mill process.
Figure 10:
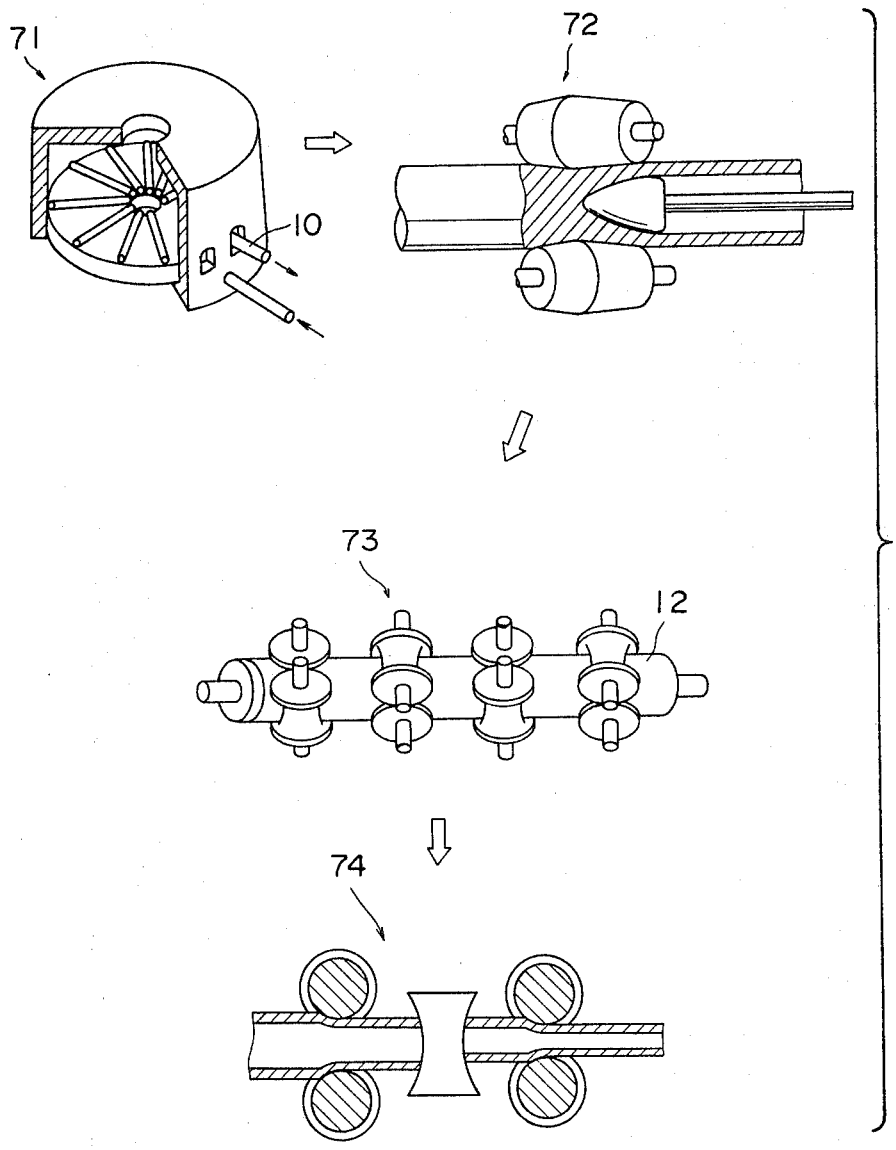
FIG. 10 PRIOR ART
FIG. 10 is an illustration showing a tube manufacturing line employing a multi-stand pipe mill.

Next, the effect of the process according to the invention will be explained on the basis of concrete examples. FIGS. 4(*a*) and 4(*b*) are graphs showing observation data on the wall eccentricity correcting effect of a 3-roll type wall-thickness equalizer in accordance with the invention. FIGS. 5(*a*) and 5(*b*) are graphs showing data of similar nature observed with a 2-roll type rotary mill for comparison purposes. The data presented in FIGS. 4(*a*) and 4(*b*) relate to the results observed with a 3-roll type equalizer having a feed angle of 6, whereas the data in FIGS. 5(*a*) and 5(*b*) relate to the results observed with a 2-roll type rotary mill having a feed angle of 8°. In the graphs, outside-diameter reduction ratio is given on the abscissa, and correction ration of wall eccentricity $$\left(\frac{\text{max. thickness} - \text{min. thickness}}{\text{mean thickness}} \times 100\%\right)$$

on the ordinate. The wall eccentricity ratio with respect to each hollow shell 11' prior to being fed to the equalizer or rotary mill, as the case may be, is used as a parameter.

In FIGS. 4(*a*) and 5(*a*), data given relate to results with respect to shells wherein t/D (wall thickness/outside diameter) is 20%, and data in FIGS. 4(*b*) and 5(*b*) relate to results with respect to shells, t/D 10%. It is apparent from these graphs that the 3-roll type wall thickness equalizer and 2-roll type rotary mill, both have positive effects in improving wall eccentricity. Furthermore, it is clear that the greater the outside-diameter reduction ratio, the more significant is the effect of correction of wall eccentricity; similarly, the greater the shell wall eccentricity and the higher the wall thickness to diameter ratio (t/D), the more remarkable is the effect of correction of wall eccentricity. It is also noted that the 3-roll wall-thickness equalizer according to the invention is more effective than the 2-roll rotary mill. Where the latter mill is used, its effect in correcting wall eccentricity ratio is relatively small if t/D is 10%; and no significant effect is obtainable unless outside-diameter reduction ratio is increased up to 50% or so. However, increasing the outside-diameter reduction ratio to 50% is undesirable in many ways: smooth roll contact relative to the shell may be hindered; wrinkles may tend to develop in the shell interior; the billet diameter is required to be about double the diameter of the shell at the outlet end of the rotary mill, which fact would make it difficult to provide a heating furnace of a suitable design, particularly in view of a substantially heavier load on the hearth; and not economical. From a practical point of view, therefore, it is not advisable to apply a 2-roll type rotary mill as a wall-thickness equalizer.

Table 1 presents comparative data on billet diameter, tube outside diameter, and wall thickness at various stages in the process of the invention and at those in conventional Mannesmann mandrel mill process.

TABLE 1

| | | In mm | | |
|---|---|---|---|---|
| Process | Billet | Piercer | Wall thickness equalizer | Mandrel mill |
| Invention | 205ϕ | 205ϕ × 42.5t | 186ϕ × 45.2t | 158ϕ × 30t |

TABLE 1-continued

| | | In mm | | |
|---|---|---|---|---|
| Process | Billet | Piercer | Wall thickness equalizer | Mandrel mill |
| Conventional | 186 | 186ϕ × 42.5t | — | 158ϕ × 30t |

Fifty samples were taken of tube from mandrel mill stage in each process and examined as to wall-eccentricity ratio. Whereas the eccentricity ratio was 12% with tubes manufactured under the conventional process, tubes from the process of the invention showed considerable improvement, with an eccentricity ratio of 5% only.

As can be readily seen from this comparison, the process of this invention enables to make seamless metal tubes of which wall eccentricity ratio are low, because the eccentric wall eccentricity as illustrated in FIG. 7, is corrected by said wall-thickness equalizer before shells are fed to continuous elongating mill. Moreover, the wall-thickness equalizer without such a tool as mandrel bar or plug is more simple in construction, cost less, and requires less space as compared with rotary elongator. When outside diameter reduction ratio is selected suitably, the wall-thickness equalizer fills the same functions as a shell sizer and enables to decrease the number of diameter sizes of billets to be supplied to meet various different specification and thus to establish suitable production lines for continuous billet casting.

The process described above is applicable to various, tube manufacturing line with hot working, that is, multi-stand type mills such as Mannesmann mandrel mill line, Mannesmann multi-stand pipe mill line, and single-stand type mills such as Mannesmann plug mill line, Mannesman assel mill line and Mannesmann pilger mill line.

What is claimed is:

1. A process for manufacturing seamless metal tubes which comprises the steps of piercing a billet in a piercing mill to form a hollow shell, subjecting the said shell to rolling to equalize the wall thickness by means of a rotary mill having 3 rolls without any internal tools and thereafter reducing the wall thickness of said shell in an elongating mill.

2. A process for manufacturing seamless metal tubes as set forth in claim 1, wherein said elongating mill is a multi-stand type mill.

3. A process for manufacturing seamless metal tubes as set forth in claim 1, wherein said elongating mill is a single-stand type mill.

4. A process for manufacturing seamless metal tubes as set forth in claim 1, wherein said rotary mill has truncated cone shape rolls.

5. A process for manufacturing seamless metal tubes as set forth in claim 1, wherein said rotary mill has barrel shape rolls.

* * * * *